United States Patent [19]

Sanchez Fernandez

[11] Patent Number: 4,663,182

[45] Date of Patent: May 5, 1987

[54] METHOD OF COATING A SURFACE WITH A REFLECTING EFFECT

[76] Inventor: Emilio Sanchez Fernandez, Moliere No. 44, Mexico City 5, Mexico

[21] Appl. No.: 809,566

[22] Filed: Dec. 16, 1985

[51] Int. Cl.[4] ..... B05D 3/06; B05D 3/02; B05D 5/06

[52] U.S. Cl. ..... 427/37; 427/163; 427/203; 427/204

[58] Field of Search ..... 427/163, 199, 204, 203, 427/37; 350/105

[56] References Cited

U.S. PATENT DOCUMENTS

| | | | |
|---|---|---|---|
| 2,294,930 | 9/1942 | Palmquist | 427/204 X |
| 4,075,049 | 2/1978 | Wood | 427/204 X |
| 4,265,937 | 5/1981 | Kameya et al. | 427/163 |

FOREIGN PATENT DOCUMENTS

| | | | |
|---|---|---|---|
| 60-217302 | 10/1985 | Japan | 350/105 |

*Primary Examiner*—Evan K. Lawrence

*Attorney, Agent, or Firm*—Ostrolenk, Faber, Gerb & Soffen

[57] ABSTRACT

A method of applying a reflecting effect to a design drawn on a surface of material. The method comprises preparing the surface to be treated, using a preparation technique dependent upon the material. The preparation includes cleaning the surface and for certain surfaces, such as plastics, to sensitizing the surface to receive the colors to be later applied. Thereafter, the design to be applied is initially applied to the surface. A coat of varnish is applied over it. An aluminized surface is applied over that. Then the various colors of the design are applied according to the original design which had been applied beneath the coat of varnish. Once the colors have dried, a further coat of varnish is applied and microspheres of glass are strewn over the coat of varnish to be affixed therein as the varnish dries, thus obtaining a surface with a reflecting effect. A further durable coat of a flexible varnish is thereafter applied.

15 Claims, No Drawings

METHOD OF COATING A SURFACE WITH A REFLECTING EFFECT

BACKGROUND OF THE INVENTION

The present invention relates to a method of painting and/or printing surfaces of any type of material, such as a material selected from among the group consisting of metals, non-metals, rubbers, plastics, and the like, for imparting a reflecting effect to such surface.

There are various known techniques for obtaining reflecting effects on various surfaces. One is to directly apply an aluminum paper on that surface, which paper has been cut by different rollers into various stratified shapes to refract light. Another manner of obtaining a reflecting surface is by adhering reflecting paper to the surface. However, these techniques have the drawback that they cannot be used for all types of materials. For instance, when reflecting paper is applied to a surface whose coefficient of expansion is greater than that of the reflecting paper, breaks are produced in the reflecting paper so that the surface in question is spoiled and has to be replaced, resulting in additional cost.

Reflecting and aluminum papers cannot be easily applied, for instance, to rubber or plastic, since both of the reflective and aluminum paper lack the necessary flexibility and adherence. The use of reflecting or aluminum papers on certain surfaces is thus limited. In particular, after a short period of use, applied materials of high elasticity are damaged by breaking in numerous directions due to the differences in the elasticities of those materials from that of the backing materials and of the glue applied to the surface. Therefore, this method has remained unused due to the very short life of the product produced.

For metallic or solid surfaces, although the problems caused by expansion are practically non-existent, the method of the present invention achieves the same goal in a far more economical and reliable manner.

SUMMARY OF THE INVENTION

It is an object of the present invention to provide a method for printing and/or painting surfaces of any type for the purpose of producing reflecting printing on any material directly and in a more economical and reliable manner than with the prior art techniques.

The method of the present invention achieves direct printing or painting of surfaces. It comprises a method and treatment which have been found suitable in accordance with a prior study carried out on the materials and the compatibility of all the elements which participate in that method, such as the chemicals employed, inks and microspheres of glass (which may be used by themselves or in combination with other materials, such as aluminum filings, and the like), as to their different diameters and indices of reflection, which will be used during performance of the method of the invention.

In general, the method of the invention comprises an analysis and classification of the different materials to which the reflecting effect will be imparted. The purpose of this classification is to provide each material with a prior treatment which is suitable for it.

While known techniques consist in gluing a cut metallic paper or reflecting paper to a receiving surface, the principal characteristic of the method of the invention is that the surface in question is first treated by painting or printing the desired design on it, and the reflecting effect is imparted to it subsequently. This characteristic makes the method of the invention quite versatile, since it can be adapted to any technique of painting, printing, engraving, or the like in order to obtain a reflective surface.

DESCRIPTION OF A PREFERRED EMBODIMENT

The method of the invention is now described for a silk-screen process for purposes of illustration and not of limitation.

The material or surface which is to be printed has requirements due to its nature or composition. That surface must be treated in the following manner in order to achieve good adherence between that surface and the ink.

(a) Apply to the surface to be painted and/or printed a grease remover, such as perchlorethylene or any other commercial grease remover, in order to remove the silicones and similar additives which might be on that surface.

(b) If the material permits or requires it, the surface to be printed should be sanded in order to obtain better fixing of the ink.

(c) If necessary, in accordance with the type of material which is to be printed or painted (as in the case of plastics), the surface should be heat treated. This can be done either by placing it in an oven for approximately 10 seconds at a temperature of between 170° C. and 200° C. approximately or else by placing it beneath a suitable electric arc in order to obtain the same result. In both cases, the heat treatment is performed immediately prior to the printing.

(d) If the material of the surface is plastic, or the like, the surface is sensitized by means of a chlorinated solution, which will change the surface of the material into an "easier material". A priming solution, preferably but not necessarily Bally 7 solution, which is sold by Bally CTU of Switzerland, may be used. It is applied with a sponge and is allowed to dry before the printing is done.

(e) Next, printing or painting is performed on the surface to create a drawing depicting the design.

(f) Next, a coat of a suitable transparent varnish is applied to the entire surface, on which the corresponding drawing has previously been placed. In the case of plastic, the varnish could, for instance, be a varnish sold under the trademark Siebruckfarbe Maraflor TK by Marabuwerke Erwin Martz GmbH of Germany. The varnish prevents the inks from coming into direct contact with the surface and reacting with it.

(g) Over the first coat of varnish and before it has dried, an aluminized base is applied consisting of powdered aluminum mixed with transparent varnish, in a ratio of 10:1 by weight.

(h) After the coat of varnish with the aluminum dust has dried, the application of colors is commenced in accordance with the drawing i.e. design desired. For instance, inks may be used. The color application or printing is done color by color, and at intervals of time sufficient to permit the complete drying of each color before the next one is applied.

(i) After all of the inks have been applied to the surface to be treated, a suitable transparent varnish is again applied to the entire surface, such as the varnish manufactured under the trademark Impertrans by Imperquimia, S.A., or any other suitable varnish. The varhish is completely flexible to such an extent that it does not crack no matter how much it is bent. It is transparent to such an extent that it will not alter the reflective effect. The varnish is completely adhesive to the materials to be coated. It imparts full protection to the surface which is to be coated so that it will withstand different climatological conditions, mud, acids, etc.

(j) After application of the transparent, flexible varnish and before it dries, the surface is immediately strewn with glass microspheres of a diameter such as to passs through a 170 mesh screen and having an index of reflection of 1.9. After microspheres have been applied, the surface is left undisturbed until the varnish onto which the microspheres have been applied is completely dry.

(k) The now dry surface with the microspheres on it, is brushed, with a brush, or the like, in order to eliminate the excess microspheres which may not have adhered to the varnish.

(l) The transparent varnish used in step (i) is again applied to the surface to protect the surface and give it greater durability.

The steps set forth above produce a reflective painted or printed surface of improved characteristics. The method is different from, more effective, versatile and less expensive than known techniques and has the further advantage that with the method of the present invention, as is not true of already known techniques, surfaces of any type of material can be printed.

The present invention has numerous applications. Two groups of applications of fundamental importance can be pointed out, traffic signs and advertising signs.

Examples of the numerous fields for which the present invention can be used are mudguards for automotive vehicles, anti-static devices, wheels of automotive vehicles, highway signs, markings on vehicle accessories, etc.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method of imparting a reflective effect to a surface, comprising:

(a) cleaning the surface to free it of dust, silicone, additives, or the like;

(b) creating a drawing upon the surface which drawing depicts a design to which a reflective effect is to be imparted;

(c) applying a transparent varnish to the surface for preventing colorings subsequently to be applied from coming into contact with the surface for avoiding reaction between the colorings and the surface;

(d) permitting the varnish to dry;

(e) applying colorings to the surface over and according to the previously applied drawing;

(f) after the colorings have been applied, applying a transparent varnish to the surface;

(g) after applying the transparent varnish and before it dries, strewing over the surface microspheres of glass; then permitting the transparent varnish with the microspheres strewn thereover to dry;

(h) after the surface with the microspheres has dried, brushing the surface to remove microspheres which may have remained on the surface without adhering thereto after the surface has dried; and (i) thereafter applying to the surface a transparent varnish in order to impart greater durability to the surface.

2. The method of claim 1, wherein the colorings are applied at time intervals sufficient to permit complete drying between application of each color.

3. The method of claim 1, wherein the microspheres of glass are of a diameter such that they pass through a 170 mesh screen and have an index of reflection of 1.9.

4. The method of claim 1, wherein after step (c) the method further includes the step of forming an aluminized surface on the surface by mixing and applying powdered aluminum mixed with transparent varnish over the varnish applied in step (c) prior to step (d).

5. The method of claim 4, wherein the powdered aluminum and the transparent varnish are in a proportion by weight of 10:1.

6. The method of claim 1, wherein the cleaning of the surface in step (a) includes sanding the surface for better later affixation of the colors.

7. The method of claim 6, wherein after cleaning the surface in step (a), heat treating the surface for better affixation of the colorings and varnish.

8. The method of claim 7, wherein the heat treatment comprises subjecting the surface in an oven to a temperature of 170°–200° C. for approximately 10 seconds.

9. The method of claim 7, wherein the heat treatment comprises exposing the surface in an electrical arc for heat treatment.

10. The method of claim 7, further comprising sensitizing the surface for receiving the colorings after the cleaning and the heat treatment of the surface.

11. The method of claim 10, wherein the surface sensitizing comprises applying a solution to the surface in order to sensitize it to better receive the colors.

12. The method of claim 11, wherein the solution applied to the surface is a chlorinating solution.

13. The method of claim 1, wherein the transparent varnish which is applied in step (i) after the colorings and the glass microspheres have been applied is a varnish that is resistant to climate conditions, acid and mud and which does not darken over time.

14. The method of claim 13, wherein the varnish has a flexibility such that it does not crack although the surface and the varnish layer may be bent and which varnish layer is sufficiently transparent so as to not interfere with the reflecting effect and which varnish is adherent to the surface and the colorings and the microspheres which it coats.

15. The method of claim 1, wherein the varnish that is applied in step (i) after the microspheres have been applied has a flexibility such that it does not crack although the surface and the varnish layer may be bent and which varnish layer is sufficiently transparent so as to not interfere with the reflecting effect and which varnish is adherent to the surface and the colors and the microspheres which it coats.

* * * * *